US007021007B2

(12) United States Patent
Jacobs

(10) Patent No.: US 7,021,007 B2
(45) Date of Patent: Apr. 4, 2006

(54) DOUBLE-SIDED SLIDING DOOR ASSEMBLY

(75) Inventor: Kenneth Jacobs, Guildford (GB)

(73) Assignee: Home Decor Holding Company, Charlotte, NC (US)

( * ) Notice: Subject to any disclaimer, the term of this patent is extended or adjusted under 35 U.S.C. 154(b) by 209 days.

(21) Appl. No.: 10/724,191

(22) Filed: Dec. 1, 2003

(65) Prior Publication Data

US 2005/0000164 A1 Jan. 6, 2005

Related U.S. Application Data

(60) Provisional application No. 60/484,328, filed on Jul. 3, 2003.

(51) Int. Cl.
*E05D 13/00* (2006.01)
*E05D 15/06* (2006.01)
*A47H 15/00* (2006.01)

(52) U.S. Cl. ..... 49/425; 49/409; 49/410; 16/91; 16/87 R; 16/96 R; 16/97

(58) Field of Classification Search ..... 49/425, 49/409, 410, 411, 417, 418; 16/91, 87 R, 16/96 R, 97, 99, 105
See application file for complete search history.

(56) References Cited

U.S. PATENT DOCUMENTS

RE23,576 E * 11/1952 Klein ..... 49/420
3,826,044 A * 7/1974 Armstrong ..... 49/420
3,980,356 A 9/1976 Uehara
4,006,513 A * 2/1977 Offterdinger ..... 16/99
4,030,160 A * 6/1977 Lambertz et al. ..... 16/105
4,064,592 A * 12/1977 Riegelman et al. ..... 16/100
4,189,870 A * 2/1980 Helmick ..... 49/420
4,262,451 A * 4/1981 Dallaire ..... 49/425
4,769,949 A * 9/1988 Glendowne ..... 49/410
4,833,829 A * 5/1989 Wilson ..... 49/425
4,850,145 A 7/1989 McAfee
4,873,741 A * 10/1989 Riegelman ..... 16/105
5,042,555 A 8/1991 Owens
5,076,018 A * 12/1991 Gianfranco ..... 49/410
5,161,330 A * 11/1992 Auriemma ..... 49/420
5,224,297 A * 7/1993 Watkins ..... 49/449
5,343,594 A * 9/1994 Harvey ..... 16/105
5,349,783 A * 9/1994 Jasperson et al. ..... 49/425
5,839,228 A * 11/1998 Duffy ..... 49/410
5,860,189 A * 1/1999 An ..... 16/91
5,974,738 A * 11/1999 Jacobs ..... 49/425
6,021,547 A * 2/2000 Stagoll ..... 16/105
6,209,171 B1 * 4/2001 Pelletier et al. ..... 16/97
6,813,862 B1 * 11/2004 Perich et al. ..... 49/425

FOREIGN PATENT DOCUMENTS

EP 443303 A1 * 8/1991 ..... 49/409
FR 2691501 11/1993

* cited by examiner

*Primary Examiner*—Hugh B. Thompson, II

(57) ABSTRACT

A sliding door assembly is disclosed for use in an environment where both sides of the door are useable. The door assembly includes at least one bottom roller mechanism fitted into a lower portion of a bottom rail. The bottom roller mechanism is adjustable and concealed within the bottom rail. The door assembly further includes at least one top roller mechanism fitted into an upper portion of a top rail. The top roller mechanism is concealed in the top rail.

21 Claims, 14 Drawing Sheets

DOUBLE-SIDED SLIDING DOOR ASSEMBLY

CROSS REFERENCE TO RELATED APPLICATIONS

This application relates to and claims priority to the following: U.S. Provisional Patent Application No. 60/484,328, entitled "Double-Sided Sliding Door Assembly," filed on Jul. 3, 2003, the disclosures of which is specifically incorporated herein by reference.

BACKGROUND OF THE INVENTION

1. Field of the Invention

The present invention relates to a sliding door assembly capable for use as a door for a closet or a sliding room divider. In particular, the present invention relates to a sliding door assembly having the roller mechanism concealed in the upper and lower portions of the door such that mounting brackets for the roller mechanism are not visible from the front or rear of the door. The present invention further relates to a sliding door assembly having a top rail, a bottom rail and side stiles that are compression fit onto the panel to simplify manufacture and create a door assembly having a uniform appearance on both a front side and a rear side.

2. Description of Related Art

Sliding panel doors, such as those used in closets, are constructed from thin panels that gain rigidity from the application of a perimeter frame formed by two side, one top, and one bottom roll formed or extruded metal sections that are mechanically joined at each corner by means of a metal or plastic joining plate. The weight of the panel door is typically supported by a bottom track, and the door is provided with wheels or other slidable elements that can slide or roll within the bottom track. The top portion of the door is often retained and guided in a top "E" section track which provides downwardly depending leg portions defining vertical surfaces in which the upper portion of the panel door is retained and guided. Particularly, the upper portion of the panel door is typically provided by a top roller guide assembly that is attached to the metal or plastic frame joining plate at each top corner of the door. The top roller guide assembly typically includes a pair of wheels each rotatable about a vertical axis. The top roller guide assembly is secured to the back side of the panel door. As such, the top roller guide assembly is visible from the rear of the door panel. As the door travels along the lower and upper tracks, the upper roller guide rollers or wheels rotate against the inside parallel vertical edges of the E track and maintain a door positioned centrally within the track cavity.

SUMMARY OF THE INVENTION

It is an aspect of the present invention to provide a sliding door assembly for use in an environment where both sides of the door are visible. The double sided sliding door assembly may be used as a room divider or for use in walk-in closets where the rear side of the door is visible.

Applicant has developed an innovative sliding door assembly capable of being used as a room divider or a door for a closet. The sliding door assembly includes a top guide track. The top guide track is a adapted to mounted to the top of an opening for a closet or adjacent the ceiling when used in connection with a room divider. The sliding door assembly further includes a bottom guide track spaced from the top guide track. At least one sliding door is slidably received on a portion of the top guide track and a portion of the bottom guide track. In accordance with the present invention, one or more sliding doors may be provided. It is contemplated that multiple sliding doors may be provided when the sliding doors are used connection with a room divider.

It is an important aspect of the present invention to provide a door panel for a double sided sliding door assembly having a top rail, a bottom rail and side stiles that require no fasteners. The top rail, the bottom rail and the side stiles may be compression fit onto the door panel. In accordance with the present invention, each of the sliding doors includes a door panel having an outer periphery with a top edge, a bottom edge and pair of opposing side edges. The door panel thickness is typically from 3 mm to 15 mm, but other thicknesses are considered to be well within the scope of the present invention. It is contemplated that each of the door panels may be formed from wood, metal, plastic, extruded wood flour composites and the like. A top rail is secured to the door panel adjacent the top edge of the door panel and therebeyond. The top rail extends the full width of the door panel. A bottom rail is secured to the door panel adjacent the bottom edge thereof. The bottom rail is load bearing. The bottom rail extends the full width of the door panel. A pair of stile sections are secured to the door panel adjacent the pair of opposing side edges. The stile sections extend between the top rail and the bottom rail. In accordance with the present invention, the top rail, bottom rail and stile sections are compression fitted onto the door panel. Such a construction eliminates the need for additional mechanical fasteners. The top and bottom rails and the stile sections may be formed from extruded aluminum, roll-formed aluminum, roll-formed steel or other materials that are capable of being compression fitted onto the door panel.

It is another important aspect of the present invention to provide a bottom roller mechanism for the sliding door assembly that is adjustable to permit height adjustment of the door panel. The bottom roller mechanism is preferably concealed within the bottom rail so that the mounting portion of the mechanism is not visible from either the front or the rear of the door panel. Each door panel in accordance with the present invention further includes at least one bottom roller mechanism fitted into a lower portion of the bottom rail. Each bottom roller mechanism is slidably received within the bottom guide track. With such an arrangement, the bottom roller mechanisms are concealed within the bottom rail. The bottom roller mechanism is substantially concealed within the bottom rail such that it is not visible (except for a lower portion of a roller assembly) from either the front or the rear. This is especially important when the door panels are used as a room divider. In accordance with the present invention, the bottom roller mechanism is compression fit into the bottom rail.

Each of the bottom roller mechanism includes a mounting bracket for securing the bottom roller mechanism to the bottom rail. The mounting bracket is sized to be compression fit onto the bottom rail. Each bottom roller mechanism further includes at least one roller assembly. The roller assembly is sized to be slidably received within a track in the bottom guide track. In accordance with the present invention, each roller mechanism further includes an adjustment mechanism operatively connected to the mounting bracket. Adjustment of the adjustment mechanism adjusts the positioning of the door with respect to the bottom guide track. With such an arrangement, the height of the door panel can be raised and lowered to fit within the space defined between the top guide track and the bottom guide track. Each adjustment mechanism preferably includes a lever arm pivotally connected to the mounting bracket and an adjustment device for pivoting the lever arm with respect to the mounting bracket. The adjustment device preferably includes a screw assembly, wherein a portion of the screw assembly is secured to the lever arm. Another portion of the screw assembly is adjustable secured to the mounting bracket. A roller assembly is secured to one end of the lever arm.

It is another important aspect of the present invention to provide a top guide roller mechanism that is concealed within the top rail such that the mounting portion of the mechanism is not visible from either the front or the rear of the door panel. Each door panel in accordance with the present invention includes at least one top roller mechanism fitted into an upper portion of the top rail. Each top roller mechanism is preferably compression fit into an upper portion of the top rail. Each top roller mechanism is slidably received within the top guide track. In accordance with the present invention, each top roller mechanism includes a mounting bracket for securing the top roller mechanism to the top rail. The mounting bracket is sized to be compression fit into the top rail. The top roller mechanism includes at least one roller assembly that is slidably received on a track on the top guide track. A support structure rotatably supports the at least one roller assembly thereon. The support structure is connected to the mounting bracket. The bottom roller mechanism and the top guide roller mechanism are preferably compression fitted into the respective bottom and top rails to eliminate any necessary post assembly of rollers and guides.

In accordance with the present invention, the support structure varies depending on whether the top guide track includes downwardly opening channels or upwardly opening channels. When the top guide track includes at least one downwardly opening channel, the at least the roller assembly is substantially aligned with the support structure and the mounting bracket. With this arrangement, at least one roller assembly and at least a portion of the top rail and the door panel are received with in the downwardly opening channel. When the top guide track includes at least one upwardly opening channel, the roller assembly of the top roller mechanism is received within the upwardly opening channel. With such an arrangement, the sliding door is laterally spaced from the at least one upwardly opening channel. The support structure extends laterally from the mounting structure to the at least one roller assembly.

In accordance with the present invention, the bottom roller mechanisms and top guide roller mechanisms are designed to facilitate automatic compression fitting into the rail sections in-line with roll-forming to eliminate typical post hand assembly of rollers and guides.

The present invention is directed to a sliding panel door with rolling mechanisms concealed within the rail sections rather than typically visible from the back side—this, coupled with the absence of additional mechanical corner fixings results in a sliding panel door for use in applications where both sides of the door are exposed to view—i.e. room division and walk-in closets

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

FIGS. 1, 2, 11 and 12 illustrate a sliding door assembly 1 in accordance with a first embodiment of the present invention. The sliding door assembly 1 includes at least one sliding door 10. Each sliding door 10 is slidably received within a lower guide track 20 and an upper guide track 30. It is intended that the sliding door assembly 1 described herein can be used as door system for closet including but not limited to walk-in closets and closets with wide openings. The sliding door assembly 1 can also be used a sliding room divider for sub-dividing a room or space into more than one smaller spaces. It is contemplated that the sliding door assembly 1 can have varying heights and widths, which are dependent upon the size opening of the closet or the ceiling height of the space.

Figure 3:
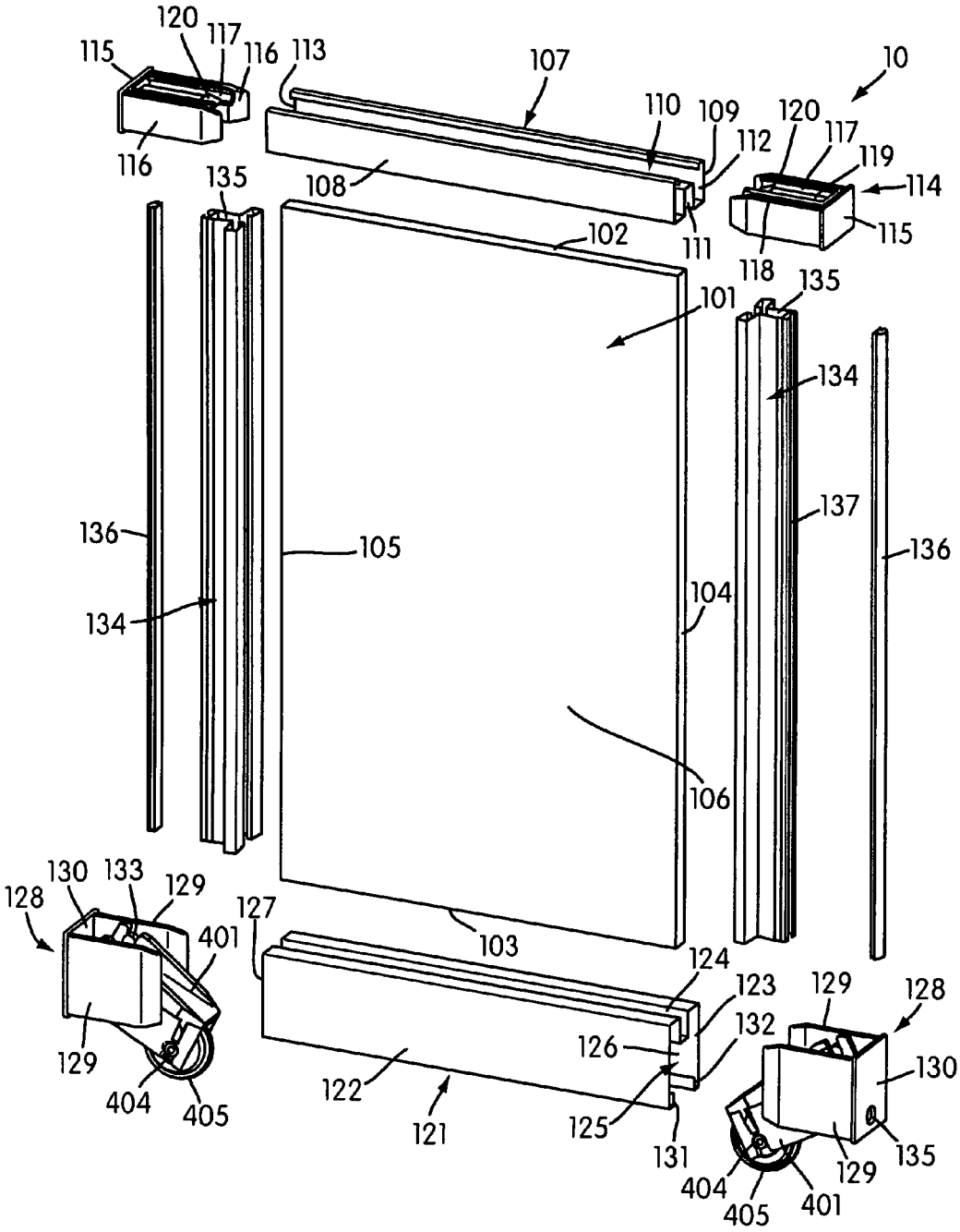
FIG. 3 is a front exploded view of a door panel of one sliding door in accordance with the present invention.

The construction of each door sliding door 10 will now be described in greater detail. As shown in FIG. 3, the sliding door 10 includes a door panel 101 having a top edge 102, a bottom edge 103, a pair of opposing side edges 104 and 105, a front surface 106 and a rear surface (not shown). The door panel 101 can be formed from wood, a wood-polymer composite material, a polymer, glass, mirrors or any other material capable of forming a door panel or room divider including but not limited to rice paper. It is preferable that the exterior finish of the door panel 101 be the same on both the front surface 106 and the rear surface so that both sides of the door panel 101 have a finished appearance when viewed in an installed position.

A top rail 107 is secured to the door panel 101 along the top edge 102 thereof. The top rail 107 is preferably formed an extruded aluminum, a roll-formed aluminum or a roll-formed steel. The top rail 107 includes a front side 108 and a rear side 109. An upwardly opening channel 110 and a downwardly opening channel 111 are located between the sides 108 and 109. The downwardly opening channel 111 is sized to receive therein the upper portion of the door panel 101 adjacent the top edge 102. The channel 111 is sized such that the top rail 107 is compression fitted onto the door panel to secure the top rail 107 to the door panel 101. This arrangement eliminates the need for visible fasteners for securing the components together, which create clean exterior surfaces of the front and rear sides 108 and 109. The top rail 107 includes a pair of opposed open ends 112 and 113, as shown in FIG. 3. A suitable adhesive can be provided within the channel 111 or along the top edge 102 of the door panel 101 to further enhance the connection between the door panel 101 and the top rail 107.

Figure 4:
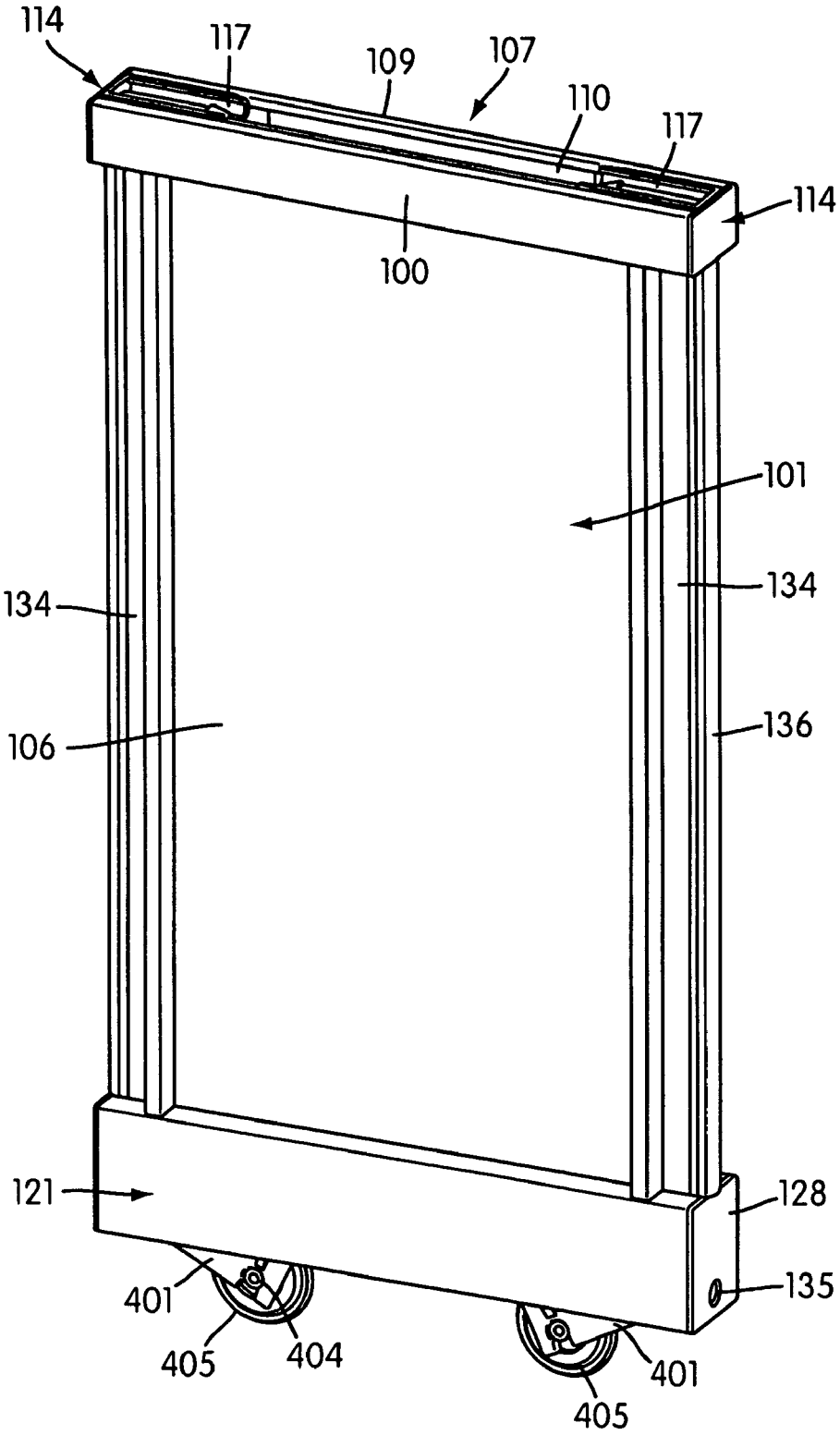
FIG. 4 is a right front perspective view of the door panel of FIG. 3 in an assembled position without an installed top guide wheel.

An end cap 114 is compression fitted into the channel 110 through the opposed open ends 112 and 113. The end caps 114 conceal the ends of open ends 112 and 113 so that the channels 110 and 111 which are compression fit on the door panel 101 are concealed and not visible from the side of the sliding door 10, as shown in FIGS. 1, 2, 4 and 10. Each end cap 114 includes an end plate 115 having at least one lateral mounting extension 116 extending therefrom. Each lateral mounting extension 116 is sized to be received in the upwardly opening channel 110 between one of the front and rear sides 108 and 109 and the downwardly opening channel 111. A suitable adhesive can be applied to the lateral mounting extension 116 to enhance the connection between the end cap 114 and the top rail 107. The end cap 114 further includes a pair of laterally extending guides 117 and 118, as shown in FIGS. 3,4 and 9. The guides 117 and 118 are sized and shaped to receive a top roller mechanism 200 there between, shown in FIG. 8.

Figure 8:
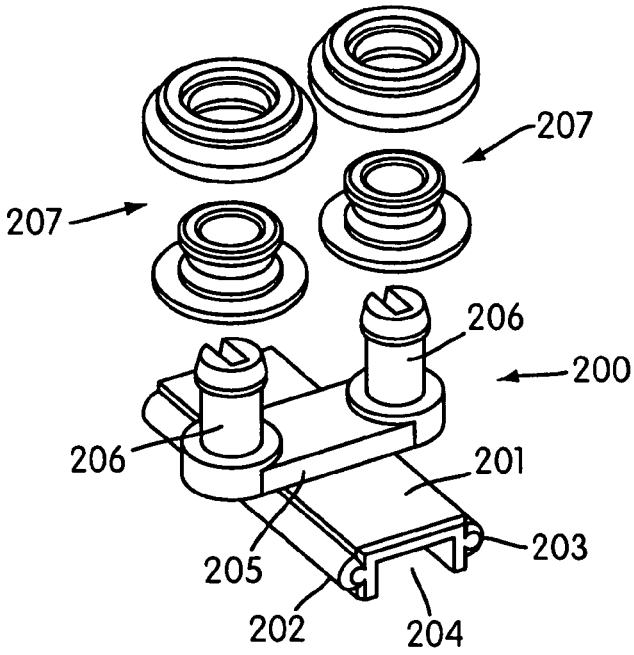
FIG. 8 is an exploded view of a top guide wheel for the sliding door assembly of FIG. 1.
Figure 9:
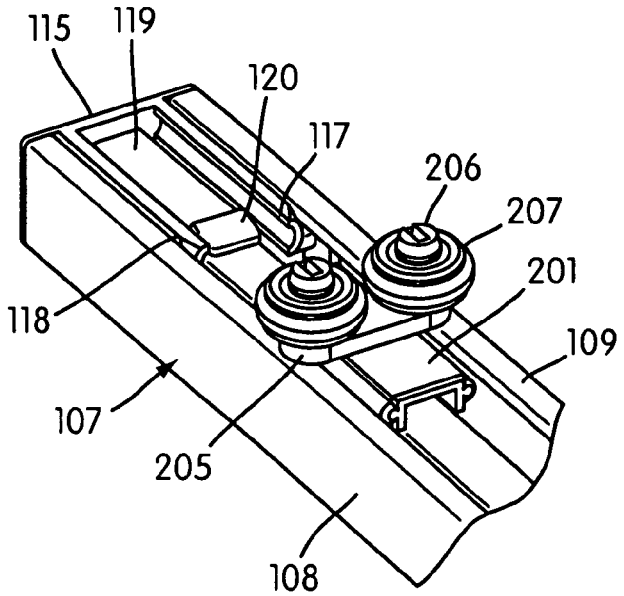
FIG. 9 is a top perspective view of the top guide wheel of FIG. 8 in an installed position.
Figure 10:
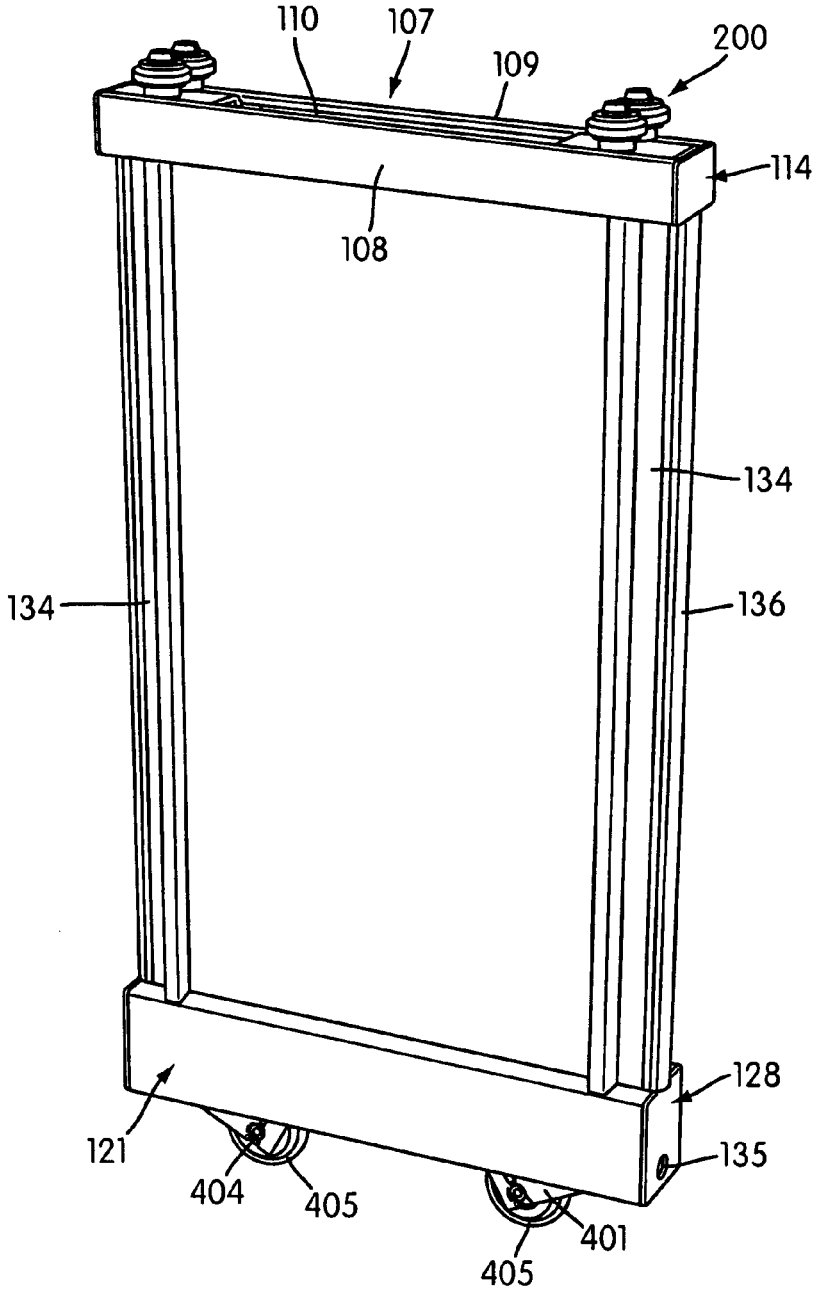
FIG. 10 is a right front perspective view of the door panel of FIG. 4 with the top guide wheels in an installed position.
Figure 11:
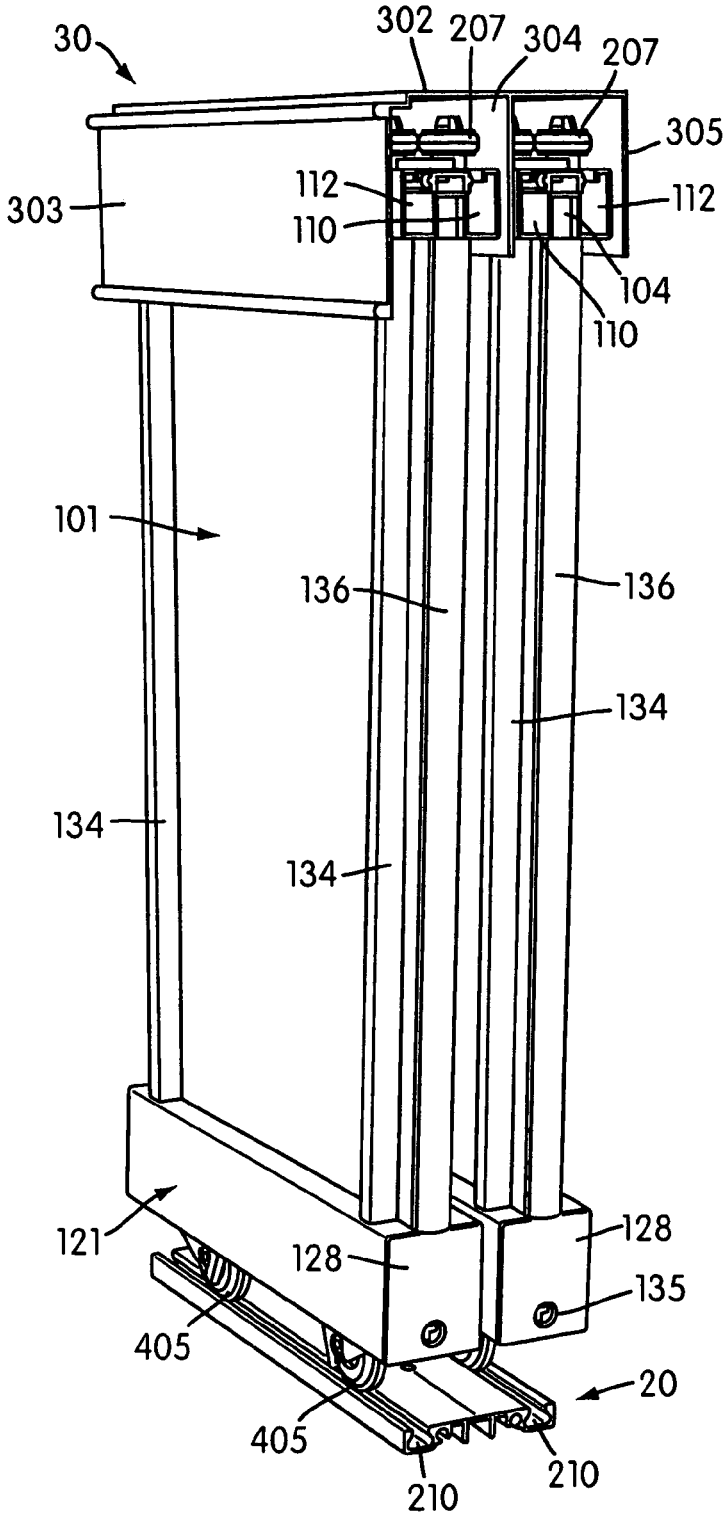
FIG. 11 is a right front perspective view of the sliding door assembly of FIG. 1 with the top end cap removed.
Figure 12:
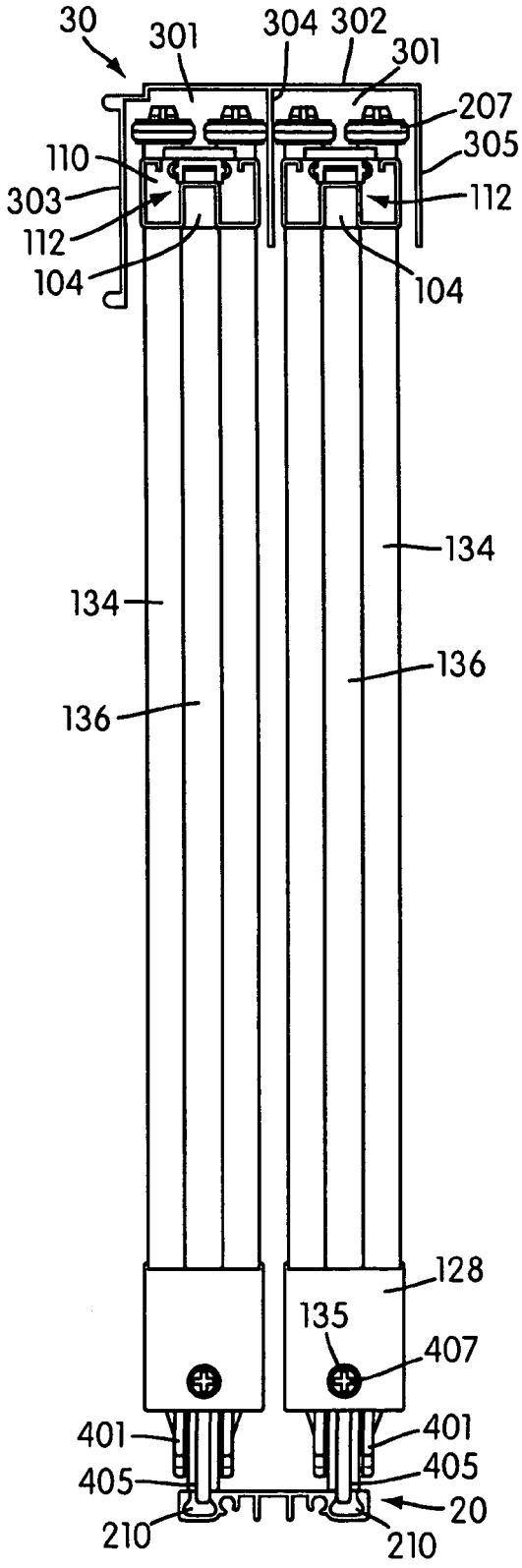
FIG. 12 is a right side view of the sliding door assembly of FIG. 11.

Each top roller mechanism 200 includes a molded base 201 having elongated ribs 202 and 203 extending from opposing sides thereof, as shown in FIG. 8. The ribs 202 and 203 have a configuration that is complimentary to the guides 117 and 118 such that base 201 and ribs 202 and 203 are compression or friction fit between the guides 117 and 118. A channel 204 is formed in a lower portion of the base 201. The channel 204 is sized to receive a laterally extending finger 119 extending from the end cap 114. The finger 119 includes a raised end portion 120. The finger 119 is sized such that the finger 119 extends through the channel 204 and the raised end portion 120 is positioned outside the channel 204 such at a portion of the end portion 120 engages an end surface of the base 201 to limit lateral movement of the top roller mechanism 200 when the base 201 is in an installed position between the guides 117 and 118. Each top roller mechanism 200 further includes a roller mount 205 secured to a top surface of the base 201. The mount 205 can be integrally formed with the base 201. The mount 205 further includes at least axle 206 formed thereon for receiving roller assembly 207 thereon. The roller assembly 207 is rotatable about the axle 206. As shown in FIGS. 11 and 12, the mount 205 is sized to span the upwardly opening channel 110 such that opposing edges of the mount 205 rest on the front and rear sides 108 and 109 of the top rail 107.

As shown in FIGS. 1, 2, 11 and 12, the sliding door assembly 1 includes an upper guide track 30. The upper guide track 30 is preferably an elongated extruded body having one or more downwardly opening channels 301 formed therein. The track 30 includes a base 302. The base 302 serves a mounting surface for mounting the track 30 to either the upper portion of a door or closet opening or the ceiling of a room or interior space. The base 302 can be secured to the ceiling or opening using suitable fasteners. A plurality of walls 303, 304 and 305 extend downwardly from the base 302. The walls 303, 304, 305 are laterally spaced to form the channels 301 therebetween. Although two channels 301 are illustrated, the present invention is not considered to be so limited; rather a single channel can be provided or more than two channels 301 can be provided. The use of multiple channels 301 may be used when multiple doors 10 are necessary to divide a large space.

Figure 1:
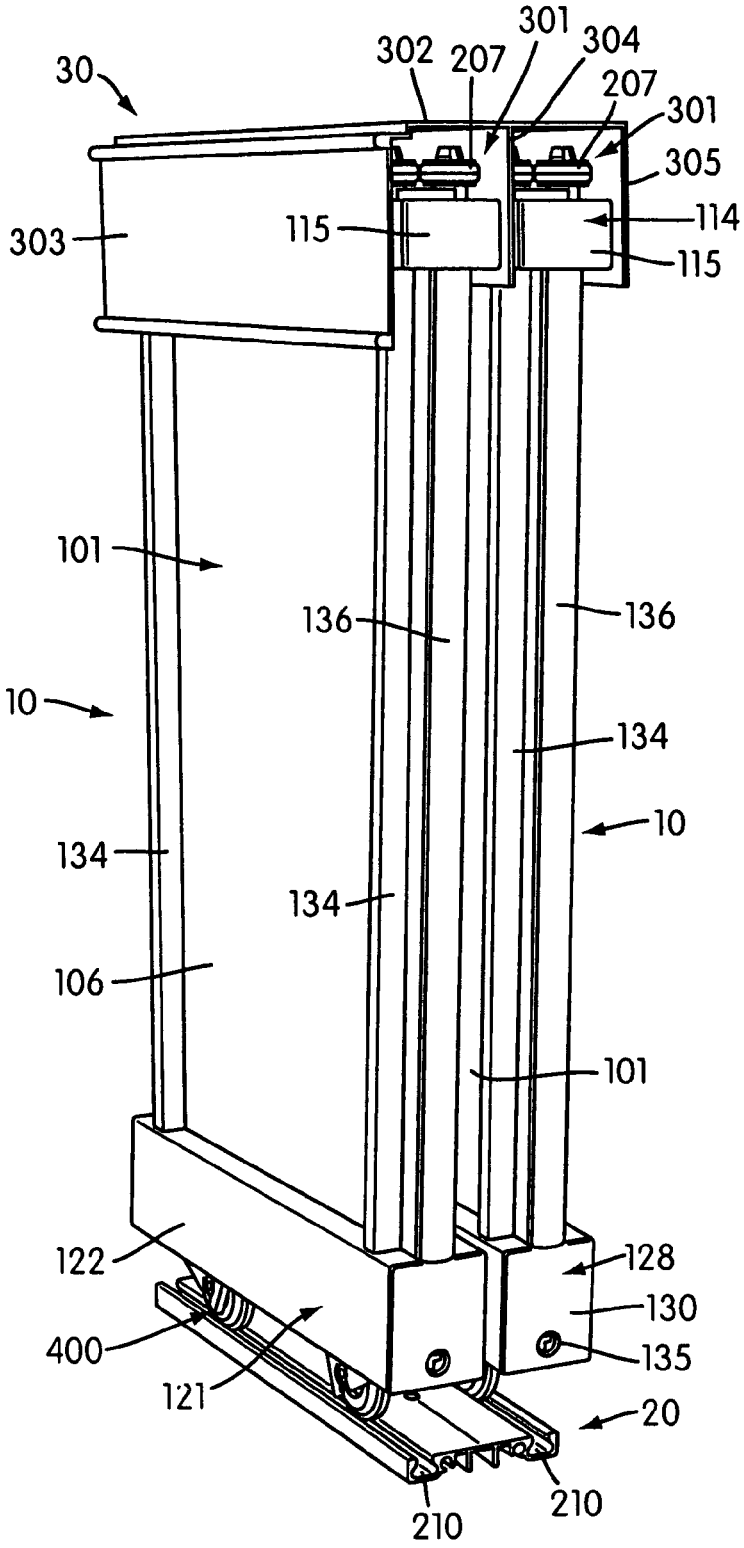
FIG. 1 is a right front perspective view of a sliding door assembly in accordance with an embodiment of the present invention.
Figure 2:
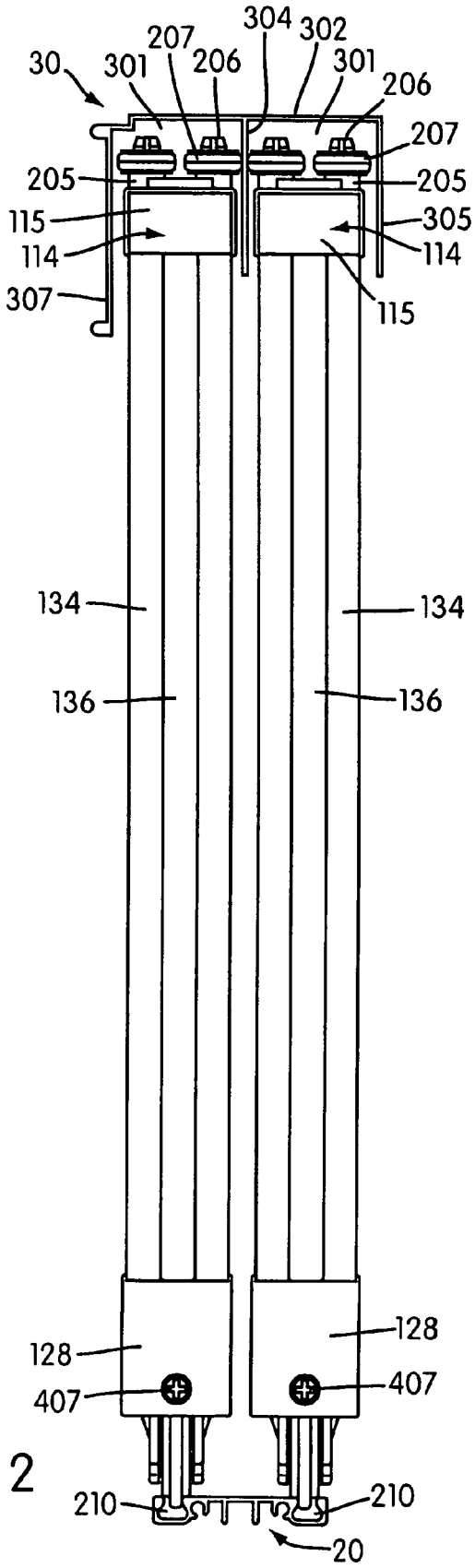
FIG. 2 is a right side view of the sliding door assembly of FIG. 1.

As shown in FIGS. 2 and 12, the channels 301 are sized to receive the top roller mechanism 200 therein such that the roller assemblies 207 contact opposing side walls of the channel 301 to limit side to side movement of the sliding door 10 within the channel 301. The walls 303, 304, 305 are sized to extend downwardly a sufficient distance to cover the top rail 107. One or more of the outwardly facing walls 303 and 305 can include a decorative finished surface.

As shown in FIGS. 3 and 9, a bottom rail 121 is secured to the door panel 101 along the bottom edge 103 thereof. Like the top rail 107, the bottom raid 121 is preferably formed from an extruded aluminum, a rolled aluminum or rolled steel or any other suitable material. The bottom rail 121 includes a front side 122 and a rear side 123. An upwardly opening channel 124 and a downwardly opening channel 125 are located between the sides 122 and 123. The upwardly opening channel 124 has a configuration similar to the channel 111 such that the door panel 101 adjacent the bottom edge 103 is compression fit within the channel 124. No additional fasteners are needed to secure the bottom rail 121 to the door panel 101. A suitable adhesive can be positioned within the channel 124.

The bottom rail 121 includes open ends 126 and 127. The downwardly opening channel 125 is sized to receive a bottom end cap 128 therein. Each bottom end cap 128 includes a pair of lateral mounting projections 129 extending from a base end 130. The front side 122 of the bottom rail 121 includes a front lower flange 131 extending inwardly within the channel 125. The rear side 123 of the bottom rail 121 includes a rear lower flange 132 extending inwardly within the channel 125. In an inserted position, one lateral mounting projection 129 is positioned within the channel 125 adjacent front side 122. The front side 122, the lower flange 132 and an upper portion of the rail 121 form a compression fit with the lateral mounting projection 129 to prevent removal of the end cap 128 from the channel 125. The other mounting projection 129 is compression fit between the rear side 123, the rear lower flange 132 and an upper portion of the rail 121. Each mounting projection 129 includes a mounting assembly 133 for pivotably mounting a bottom roller mechanism 400 thereon. As illustrated, the mounting assembly 133 includes a pivot pin. The pivot pin, however, can be replaced with a recess for receiving a portion of the bottom roller mechanism 400 therein.

Figure 5:
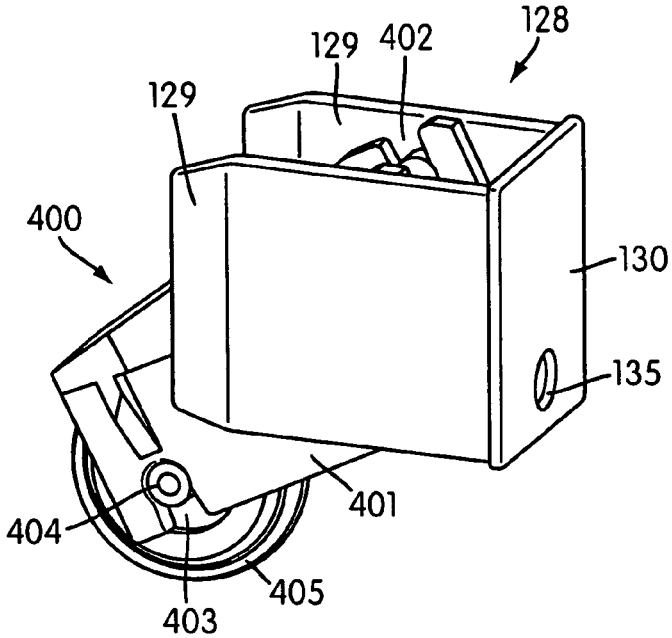
FIG. 5 is a side perspective view of a height adjustable bottom wheel assembly in accordance with the present invention.
Figure 6:
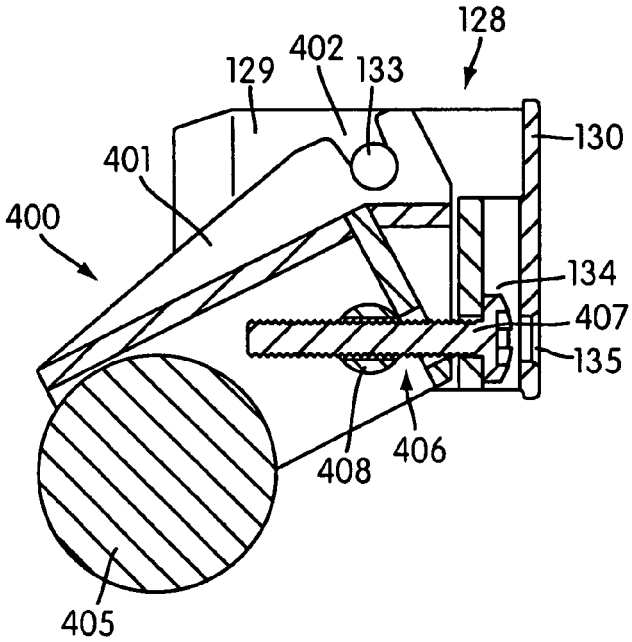
FIG. 6 is a side cross sectional view of the height adjustable bottom wheel assembly of FIG. 5.
Figure 7:
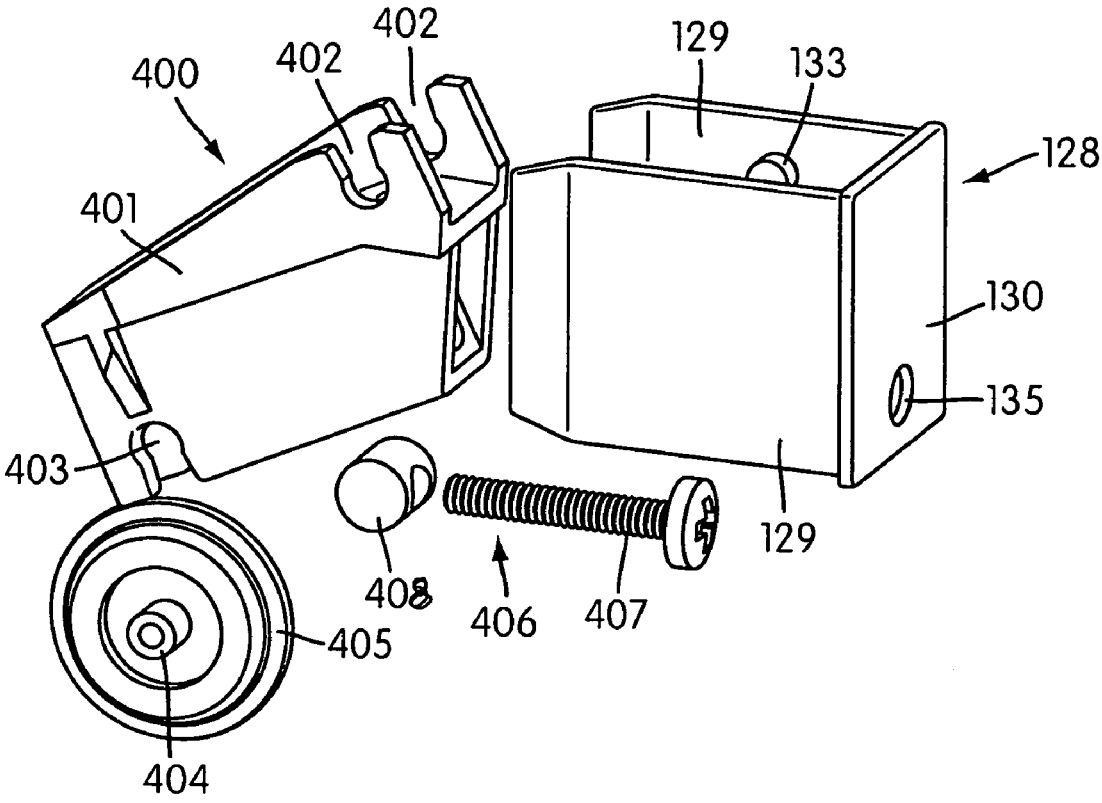
FIG. 7 is an exploded view of the height adjustable bottom wheel assembly of FIG. 5.

The bottom roller mechanism 400 will now be described in greater detail in connection with FIGS. 5–7. The bottom roller mechanism 400 includes a pivot arm 401. The pivot arm 401 is preferably formed from a molded material. The pivot arm 401 includes a recess 402 formed in an upper portion for receiving a pivot pin of the mounting assembly 133 therein. The pivot pin and the recess 402 preferably form a snap fit connection. An opposite end of the pivot arm 401 includes a recess 403. The recess 403 is sized to receive an axle 404 of a roller wheel 405 therein. The recess 403 and the axle 404 form a snap fit connection such that the roller wheel 405 is rotatably connected to the pivot arm 401.

The position of the roller wheel 405 with respect to the end cap 128 is adjustable through an adjustment mechanism 406. The adjustment mechanism 406 includes a threaded bolt 407 and a complimentary nut 408. The nut 408 is received within a recess in the pivot arm 401, as shown in FIG. 6. A portion of the bolt 407 is received within a slot 134 formed in the base end 130. The head of the bolt 407 can be accessed through an opening 135 formed in the base end 130, as shown in FIG. 7. A screw driver or suitable adjustment device can be inserted into the opening 135 to rotate the bolt 407. The rotation of the bolt 407 causes the lateral position of the nut with respect to the bolt 407 to be adjusted. This adjustment raises and/or lowers the position of the roller wheel 405 with respect to the end cap 128 and the bottom rail 121, which raises and/or lowers the position of the sliding door 10 with respect to the lower guide track 20. As shown in FIGS. 1, 2, 4, 10, 11 and 12, the bottom roller mechanism 400 is substantially concealed within the bottom rail 121.

As shown in FIGS. 1, 2, 11 and 12, the roller wheel 405 is sized to be slidably received with a guide groove 210 in the lower guide track 20. The lower guide track 20 is preferably formed from an extruded or rolled material having sufficient strength to withstand the weight of the sliding doors 10 without undergoing deformation. The lower guide track 20 is intended to be either fastened or secured to either a floor or lower surface. Like the upper guide track 30, the lower guide track 20 is shown with a pair of guide grooves 210. A single guide groove 210 or multiple guide grooves may be provided depending upon the number of sliding doors 10 and the number of channels 301 provided in the upper guide track 30. The number of grooves 210 should correspond to the number of channels 301. Adjusting the adjustment mechanism 406 will adjust the height of the sliding door 100 with respect to the lower guide track 20.

The bottom rail 121 and the bottom roller mechanism 400 have a clean appearance that is substantially the same when viewed from either the front surface 106 or the rear surface. With such an arrangement, a clean decorative appearance is achieved when viewed from either the front or rear.

A stile 134 is secured to the door panel 101 along each of the side edges 104 and 105. Each stile 134 extends from the top rail 107 to the bottom rail 121. When installed, the stiles 134, the top rail 107 and the bottom rail 121 form a frame surrounding the door panel 101. Each stile 134 is formed from the same materials as the top rail 107 and the bottom rail 121. Each stile 134 is formed with a channel 135 that is sized to be compression fit onto the door panel 101. Each stile 134 includes side portions that extend outwardly away from the door panel 101 in a direction to the front and rear surfaces of the top and bottom rails 107 and 121. A trim piece 136 is located within a groove 137 on the exterior of the stile 134. The trim piece 136 can be compression fit or glued to the groove 137. The trim piece 136 can be formed from a synthetic or elastomeric material to serve as a shock absorber between two adjacent sliding doors 10 sliding in the same groove 210 in the lower guide track 20.

The top rail 107, bottom rail 121 and stiles 134 can be easily attached to the door panel 101 to create a finished sliding door 10 with minimal assembly steps. The assembler simply compression fits the rails and stiles into the door panel 101 to create a finished sliding door that has a similar appearance when viewed from the front and the rear.

A variation of the sliding door assembly 1 will now be described in connection with FIGS. 13–18. The sliding door assembly 2 is used in connection with an upper guide track 50. The upper guide track 50 is formed from the same materials as the upper guide track 30 described above. The upper guide track 50 includes upwardly opening channels 501 and 502. The upwardly opening channel 501 is formed by a pair of upstanding walls 503 and 504. Each wall 503 and 504 includes an inwardly extending flange 505 and 506 to prevent the inadvertent removal of a first top roller mechanism 600, described in detail below. The upwardly opening channel 502 is formed by the upstanding 504 and another wall 507. Each wall 504 and 507 includes an inwardly extending flange 508 and 509 to prevent the inadvertent removal of a second top roller mechanism 610, described in detail below. The flanges 505 and 506 form an opening 510. The flanges 508 and 509 form an opening 511. The opening 510 is spaced vertically below the opening 511. A mounting flange or flanges 512 extend rearwardly from the rear wall 507. The flange(s) 512 is provided to mount the guide track 50 to either a beam or other structural member. The flanges 512 can be eliminated and the wall 507 may be secured directly adjacent the opening.

Figure 13:
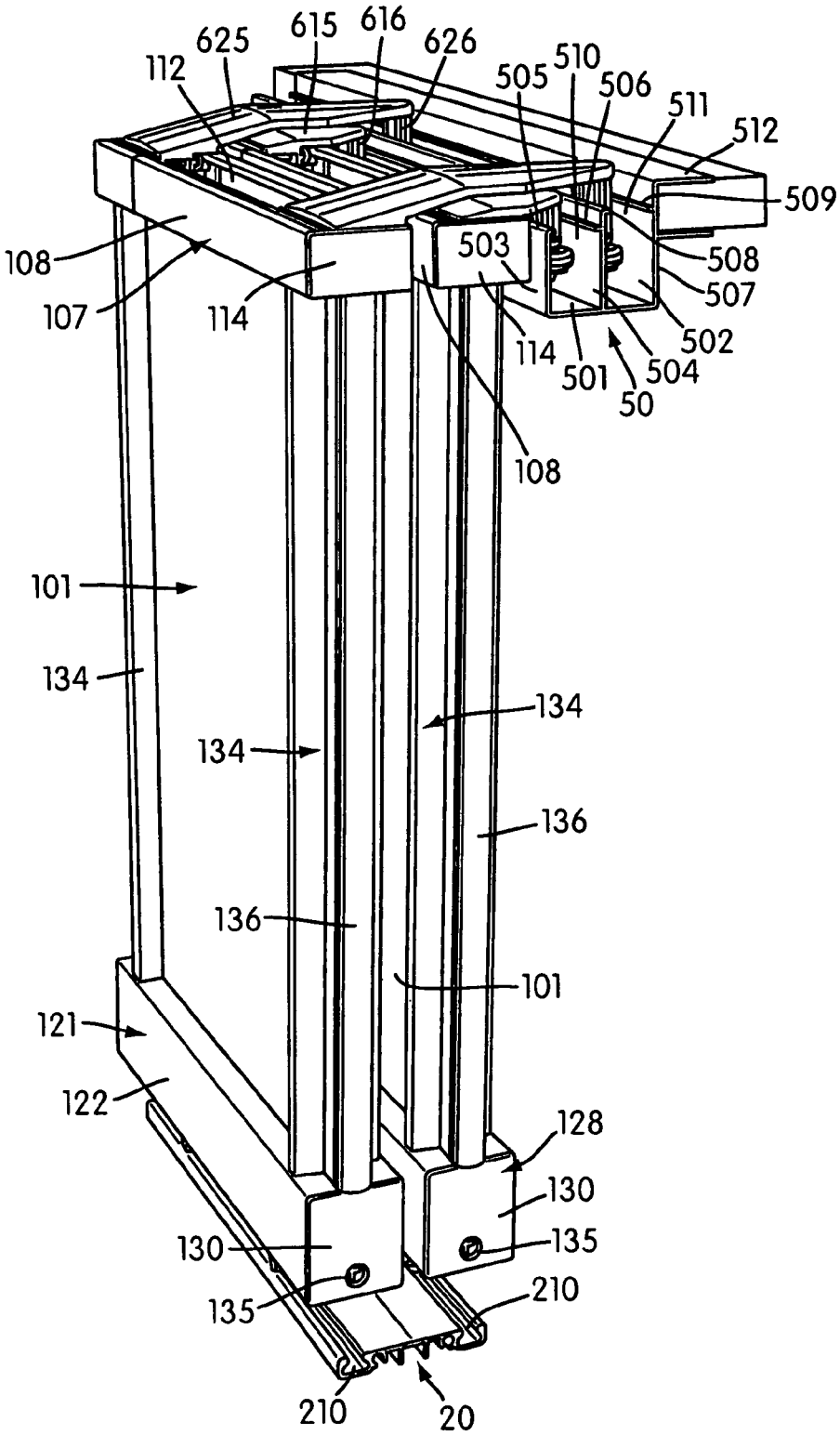
FIG. 13 is a right front perspective view of a sliding door assembly in accordance with another embodiment of the present invention.
Figure 14:
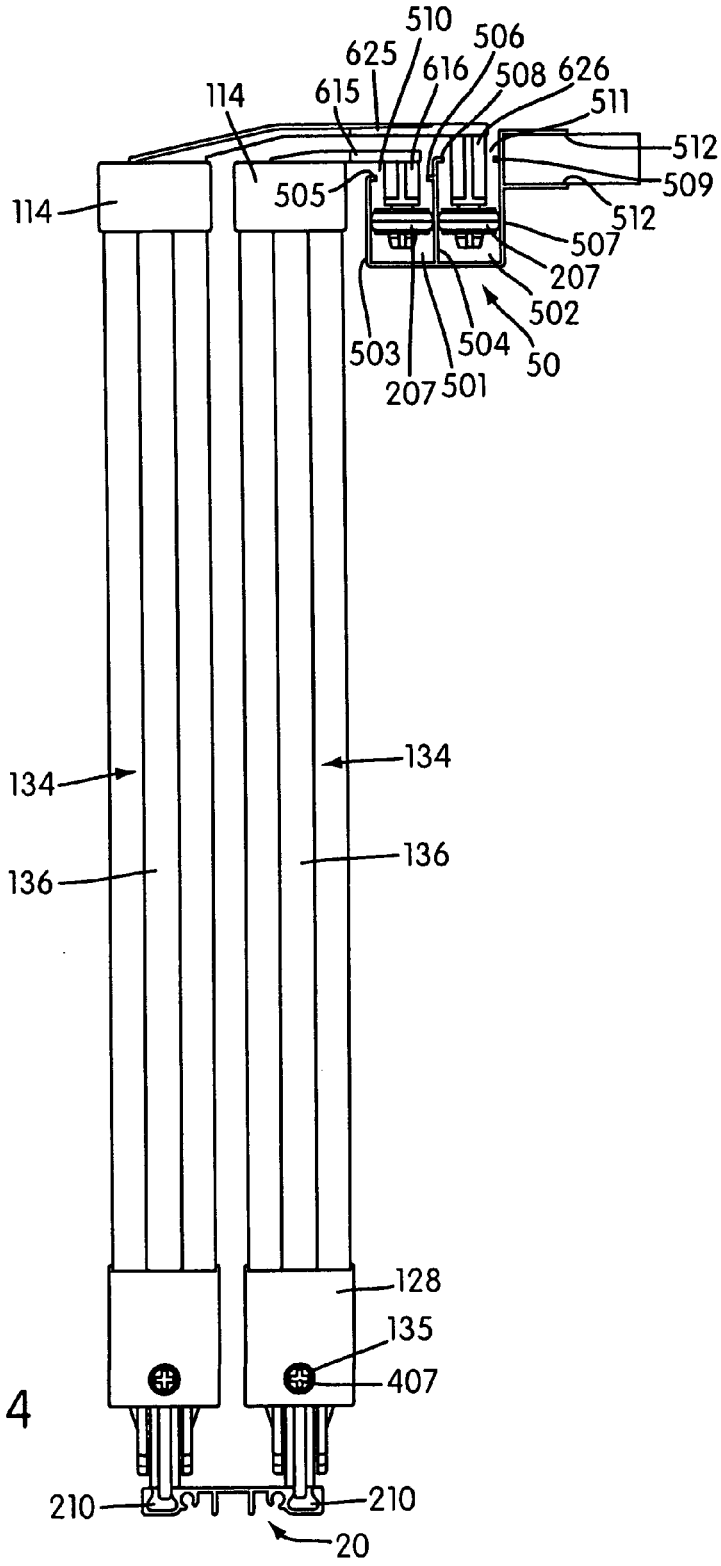
FIG. 14 is a right side view of the sliding door assembly of FIG. 13.
Figure 17:
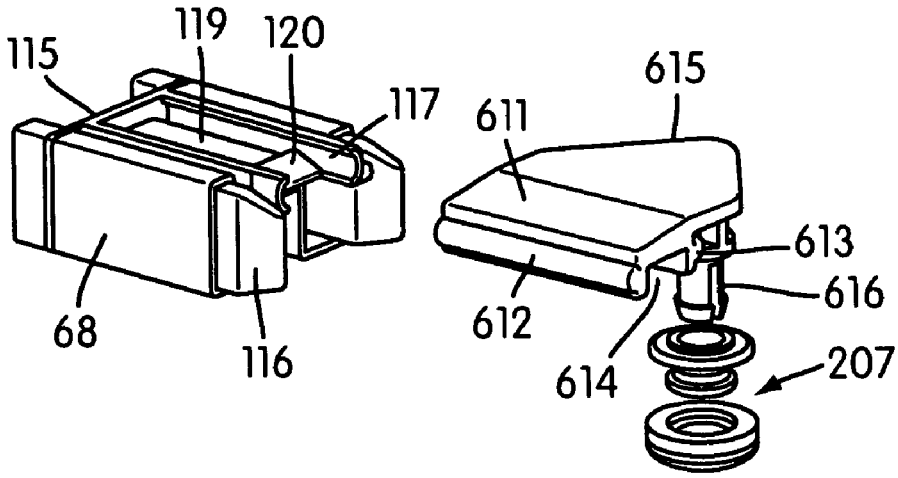
FIG. 17 is an exploded perspective view of an inner top guide wheel for the sliding door assembly of FIG. 13.
Figure 18:
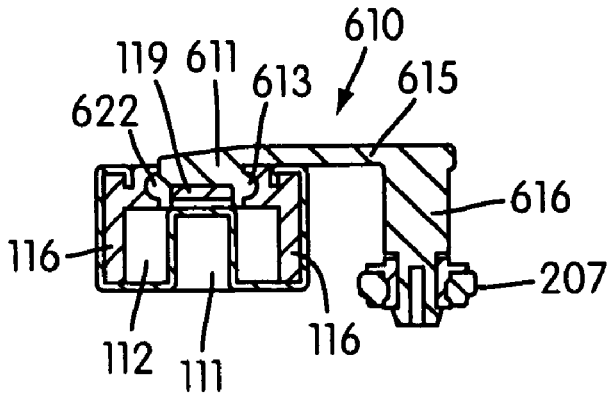
FIG. 18 is side view of the inner top guide wheel of FIG. 18.

As shown in FIGS. 17 and 18, the first top roller mechanism 610 is configured to be secured to the end cap 114 in the same manner as the top roller mechanism 200 described above. The first top roller mechanism 610 includes a molded base 611 having a pair of ribs 612 and 613. The ribs 612 and 613 are sized to fit within guides 117 and 118. The molded based 611 also includes a channel 614 formed in an undersurface thereof to receive the finger 119 in the end cap 114. A lateral arm 615 extends from one side of molded base 611 over the wall 503. An axle 616 extends downwardly from a free end of the am 615. A roller assembly 207 is rotatably affixed to the axle 616. A portion of the axle 616 and the roller assembly 207 are received within the channel 501. The flanges 505 and 506 are adapted to engage the roller assembly 207 to prevent the inadvertent removal of the roller assembly 207 from within the channel 501. The first top roller mechanism 610 is located on opposite ends of the upper portion of an inner sliding door, as shown in FIGS. 13 and 14. The top roller mechanism 610 serves to maintain the inner sliding door in proper vertical orientation. The weight of the sliding door 10 is borne by the bottom roller mechanism 400.

Figure 15:
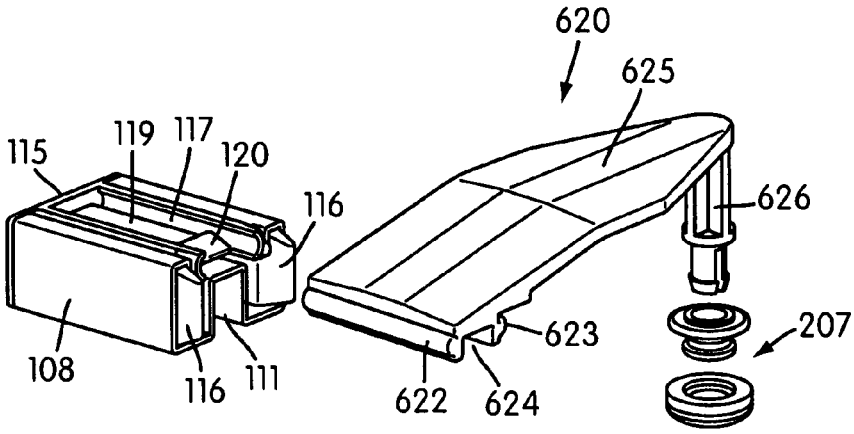
FIG. 15 is an exploded perspective view of an outer top guide wheel for the sliding door assembly of FIG. 13.
Figure 16:
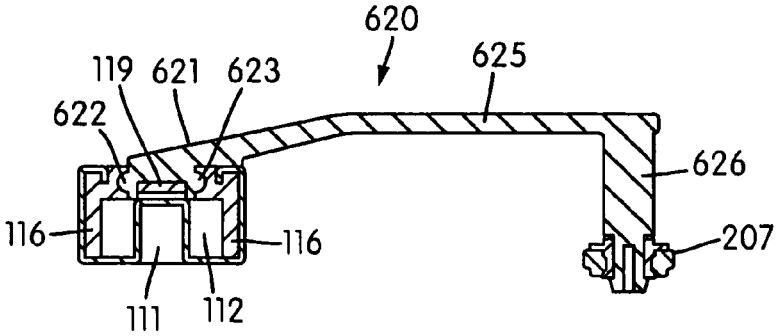
FIG. 16 is side view of the outer top guide wheel of FIG. 15.

As shown in FIGS. 15 and 16, the second top roller mechanism 620 is configured to be secured to the end cap 114 of the outer sliding door in the same manner as the top roller mechanism 200 described above. The second top roller mechanism 620 includes a molded base 621 having a pair of ribs 622 and 623. The ribs 622 and 623 are sized to fit within guides 117 and 118. The molded base 621 also includes a channel 624 formed in an undersurface thereof to receive the finger 119 in the end cap 114. A lateral arm 625 extends from one side of the molded base 621 over the lateral am 625 to the channel 502. An axle 626 extends downwardly from a free end of the arm 625. A roller assembly 207 is rotatably affixed to the axle 626. A portion of the axle 626 and the roller assembly 207 are received within the channel 502. The flanges 508 and 509 are adapted to engage the roller assembly 207 to prevent the inadvertent removal of the roller assembly 207 from within the channel 502. The top roller mechanism 620 serves to maintain the outersliding door in proper vertical orientation.

It will be appreciated that numerous modifications to and departures from the preferred embodiments described above will occur to those having skill in the art. Thus, it is intended that the present invention covers the modifications and variations of the invention, provided they come within the scope of the appended claims and their equivalents.

What is claimed is:

1. A sliding door assembly assemblable without fasteners and in which an upper guide assembly is substantially concealed, comprising:

a top guide track;

a bottom guide track spaced from the top guide track; and at least one sliding door having its upper and lower ends slidably received in a portion of the top guide track and a portion of the bottom guide track, said at least one sliding door comprising:

a door panel having an outer periphery with a top edge, a bottom edge and pair of opposing side edges;

a top rail compression fitted onto the door panel adjacent the top edge thereof;

a bottom rail compression fitted onto the door panel adjacent the bottom edge thereof;

a pair of stile sections compression fitted onto the door panel adjacent the pair of opposing side edges, said door panel integrating the stile sections and rails into a frame extending about said panel;

at least one bottom roller mechanism seated in the bottom rail, said at least one bottom roller mechanism being slidably received on the bottom guide track; and at least one top roller mechanism frictionally fitted to the top rail, said at least one top roller mechanism being slidably received within the top guide track, said top roller mechanism being concealed by said top guide track.

2. The sliding door assembly according to claim 1, wherein said at least one bottom roller mechanism is compression fitted into the the bottom rail.

3. The sliding door assembly according to claim 2, wherein said at least one bottom roller mechanism is substantially concealed within the bottom rail.

4. The sliding door assembly according to claim 1, wherein said at least one bottom roller mechanism comprises:

a mounting bracket for securing the bottom roller mechanism to the bottom rail; at least one roller assembly; and an adjustment mechanism operatively connected to the mounting bracket, whereby adjustment of the adjustment mechanism adjusts the vertical position of the door assembly with respect to the bottom guide track.

5. The sliding door assembly according to claim 4, wherein each adjustment mechanism comprises:

a lever arm pivotally connected to the mounting bracket; and an adjustment device for pivoting the lever arm with respect to the mounting bracket, and wherein the at least one roller assembly is secured to one end of the lever arm.

6. The sliding door assembly according to claim 5, wherein adjustment of the adjustment device adjusts the positioning of the at least one roller assembly with respect to the door panel.

7. The sliding door assembly according to claim 6, wherein the adjustment device includes a screw assembly, wherein a portion of the screw assembly is disposed within the lever arm, and wherein another portion of the screw assembly is adjustably secured to the mounting bracket.

8. The sliding door assembly according to claim 4, wherein the mounting bracket is compression fitted into the bottom rail.

9. The sliding door assembly according to claim 1, wherein the top rail is compression fitted onto the door panel along the top edge.

10. The sliding door assembly according to claim 1, wherein the at least one top roller mechanism is compression fitted into the top rail.

11. The sliding door assembly according to claim 1, wherein said top roller mechanism comprises:

a mounting bracket for securing the top roller mechanism to the top rail; at least one roller assembly; and a support structure for rotatably supporting said at least one roller assembly thereon, wherein the support structure is connected to the mounting bracket.

12. The sliding door assembly according to claim 11, wherein the mounting bracket is compression fitted into the top rail.

13. The sliding door assembly according to claim 11, wherein the top guide track includes at least one downwardly opening channel, and wherein at least the roller assembly of the top roller mechanism is received within said at least one downwardly opening channel.

14. The sliding door assembly according to claim 13, wherein said at least one roller assembly and at least a portion of the top rail and the door panel are received within the downwardly opening channel.

15. The sliding door assembly according to claim 11, wherein the top guide track includes at least one upwardly opening channel, and wherein the roller assembly of the top roller mechanism is received within the upwardly opening channel.

16. The sliding door assembly according to claim 15, wherein there is a pair of sliding doors and said sliding doors are laterally spaced in said at least one upwardly opening channel.

17. The sliding door assembly according to claim 16, wherein said top guide track includes a pair of upwardly opening channels, wherein said at least one roller assembly for one of the sliding doors is located in one of the upwardly opening channels and wherein said at least one roller assembly for another of the sliding doors is located in another of the upwardly opening channels.

18. The sliding door assembly according to claim 17, wherein one of the sliding doors is an inner sliding door positioned adjacent the top guide track and the other of the sliding doors is an outer sliding door positioned adjacent the inner sliding door, and wherein the support structure for said at least one mounting bracket is secured to the outer door and extends over the inner sliding door and the top roller mechanism secured to the inner sliding door.

19. The sliding door assembly according to claim 1, wherein each of the stile sections is compression fitted onto the door panel along a respective side edge of the opposing edges, and wherein each stile section extends from the top rail to the bottom rail.

20. A sliding door assembly assemblable without fasteners and in which the upper guide assembly is substantially concealed comprising:

a top guide track;

a bottom guide track spaced from the top guide track; and at least one sliding door having its upper and lower ends slidably received in a portion of the top guide track and a portion of the bottom guide track, each sliding door comprising:

a door panel having an outer periphery with a top edge, a bottom edge and pair of opposing side edges;

a top rail compression fitted onto the door panel adjacent the top edge thereof;

a bottom rail compression fitted onto the door panel adjacent the bottom edge thereof;

a pair of stile sections compression fitted onto the door panel adjacent the pair of opposing side edges;

at least one bottom roller mechanism seated in the bottom rail, said at least one bottom roller mechanism being slidably received on the bottom guide track; said at least one bottom roller mechanism comprising a mounting bracket for securing the bottom roller mechanism to the bottom rail;

at least one roller assembly; and an adjustment mechanism operatively connected to the mounting bracket, whereby adjustment of the adjustment mechanism adjusts the vertical position of the door assembly with respect to the bottom guide track;

a lever arm pivotally connected to the mounting bracket; and an adjustment device for pivoting the lever arm with respect to the mounting bracket, and wherein said at least one roller assembly is secured to one end of the lever arm, said adjustment device adjusting the positioning of said at least one roller assembly with respect to the door panel, said adjustment device including a screw assembly, a portion of the screw assembly being disposed within the lever arm, another portion of said screw assembly being adjustably secured to the mounting bracket and at least one top roller mechanism seated in the top rail, said at least one top roller mechanism being slidably received within the top guide track, said top roller mechanism being concealed by said top guide track.

21. A sliding door assembly assemblable without fasteners and in which the upper guide assembly is substantially concealed comprising:

a top guide track;

a bottom guide track spaced from the top guide track; and at least one sliding door having its upper and lower ends slidably received in a portion of the top guide track and a portion of the bottom guide track, each sliding door comprising:

a door panel having an outer periphery with a top edge, a bottom edge and pair of opposing side edges;

a top rail compression fitted onto the door panel adjacent the top edge thereof;

a bottom rail compression fitted onto the door panel adjacent the bottom edge thereof;

a pair of stile sections compression fitted onto the door panel adjacent the pair of opposing side edges;

at least one bottom roller mechanism seated in the bottom rail, said at least one bottom roller mechanism being slidable received on the bottom guide track; and at least one top roller mechanism seated in the top rail, said at least one top roller mechanism being slidable received within the top guide track, said top roller mechanism being concealed by said top guide track, said top roller mechanism comprising:

a mounting bracket for securing the top roller mechanism to the top rail;

at least one roller assembly; and a support structure for rotatably supporting said at least one roller assembly thereon, said support structure being connected to the mounting bracket; said top guide track including at least one upwardly opening channel, said roller assembly of the top roller mechanism being received within the upwardly opening channel.

* * * * *